US007472840B2

(12) United States Patent
Gregory

(10) Patent No.: US 7,472,840 B2
(45) Date of Patent: Jan. 6, 2009

(54) SPRINKLER NOZZLE INSERT ASSEMBLY

(75) Inventor: Christian T. Gregory, La Crescenta, CA (US)

(73) Assignee: Rain Bird Corporation, Azusa, CA (US)

( * ) Notice: Subject to any disclaimer, the term of this patent is extended or adjusted under 35 U.S.C. 154(b) by 552 days.

(21) Appl. No.: 10/883,940

(22) Filed: Jul. 2, 2004

(65) Prior Publication Data

US 2006/0000932 A1 Jan. 5, 2006

(51) Int. Cl.
*B05B 15/02* (2006.01)

(52) U.S. Cl. ..... 239/289; 239/390; 239/391; 239/600; 239/73; 239/74; 294/87.1; 294/87.2

(58) Field of Classification Search ..... 239/600, 239/251, 289, 203, 280, 73, 74, 390, 391, 239/222.11–222.21, 201, 209; 211/13.1, 211/60.1, 126.2, 126.12, 194, 85.18, 74; 206/505, 507; 294/87.1, 87.2; D23/214; 134/176, 179; 220/23.6
See application file for complete search history.

(56) References Cited

U.S. PATENT DOCUMENTS 2,977,963 A * 4/1961 Klint ..... 134/179
3,191,809 A * 6/1965 Schultz et al. ..... 222/182
3,604,705 A * 9/1971 Hawthorne ..... 273/148 R
5,868,316 A * 2/1999 Scott ..... 239/73
D415,415 S * 10/1999 Robertson ..... D3/315
5,964,232 A * 10/1999 Chung ..... 134/176
6,082,633 A * 7/2000 Kephart et al. ..... 239/211
6,234,411 B1 5/2001 Walker et al.
6,237,862 B1 * 5/2001 Kah et al. ..... 239/391
6,460,701 B1 10/2002 Nytko
6,520,366 B1 * 2/2003 Bradley et al. ..... 220/23.2
6,651,909 B1 * 11/2003 Bugarin ..... 239/390
D486,884 S 2/2004 Gregory et al.
6,854,663 B2 * 2/2005 Bugarin ..... 239/114
6,988,677 B2 * 1/2006 Sodemann et al. ..... 239/525

OTHER PUBLICATIONS

Hunter Industries Incorporated, *I-20 Ultra Rotors, Premium Quality Rotors for Residential and Light Commercial Applications*, 2003, pp. 3, 17-19.

* cited by examiner

*Primary Examiner*—Dinh Q Nguyen
(74) *Attorney, Agent, or Firm*—Fitch, Even, Tabin & Flannery

(57) ABSTRACT

A set of nozzle inserts is provided for use with an irrigation sprinkler system. The nozzle set includes a plurality of nozzle inserts that are removably connected to one another via a common carrier. The nozzle set is adapted for storage, transportation and handling in a nested arrangement with another nozzle set, which, in turn, is similarly adapted for storage, transportation and handling in a nested arrangement with other nozzle sets. This nested arrangement facilitates storage, transportation and handling of a relatively large number of nozzle inserts in a manner that protects each insert from unintentional removal from its set.

12 Claims, 6 Drawing Sheets

SPRINKLER NOZZLE INSERT ASSEMBLY

FIELD OF THE INVENTION

This invention relates generally to irrigation sprinklers of the type having a pop-up spray head with a removably mounted nozzle insert that sets an outwardly projected water stream with predetermined spray characteristics for the spray head and, more particularly, to a system of nozzle sets, wherein each set has a plurality of nozzle inserts that have a common carrier for convenience and effective packaging and transporting.

BACKGROUND OF THE INVENTION

Pop-up irrigation sprinklers are commonly used in irrigation systems where it is necessary or desirable to install the sprinklers in the ground so that they do not project appreciably above ground level when not in use. In a typical pop-up sprinkler, a sprinkler mechanism is telescopically housed within a generally cylindrical upright sprinkler case having an open upper end. In a normal inoperative position, a pop-up portion of the sprinkler mechanism, including a spray head, is normally spring-retracted substantially into the sprinkler case so that it does not extend or project a significant distance above the open upper end of the case. However, when water under pressure is supplied to the sprinkler case, the spray head is displaced upwardly through the open end of the case to an elevated spraying position above the sprinkler case to facilitate the delivery of an outwardly projecting stream of water to a surrounding area.

In some pop-up sprinklers, the sprinkler mechanism includes a rotary drive system to rotate the elevated spray head through continuous full circle revolutions or, alternately, back and forth within a predetermined partial arcuate path to sweep the projected water stream over a selected target terrain area. In this regard, the sprinkler mechanism has been designed to receive a removable nozzle insert selected from a set of different inserts. Each insert is designed to cause the sprinkler mechanism to produce a projecting water stream of different characteristics, such as flow rate, trajectory, stream width, area coverage etc., in accordance with the particular irrigation requirements for each pop-up sprinkler in the system. The interchangeable nozzle inserts provide a convenient and efficient system to custom-tailor the projecting water stream. Examples of rotary-drive, pop-up sprinklers of this general type include those disclosed in U.S. Pat. Nos. 4,625,914 and 4,787,558.

Nozzle inserts have been produced from lightweight, molded plastic to have a size and shape for quick and easy installation and removal on the spray head. In one form, nozzle inserts have been produced in a unitized set formed integrally with a common mold runner. The mold runner provides a convenient carrier for packaging, storing and transporting the nozzle set. An example of a carrier with such design is disclosed in U.S. Pat. No. Des. 415,415.

As mentioned above, each insert of the nozzle set can define different spray characteristics for the projecting water stream. One of the nozzle inserts can be detached quickly and easily from the carrier and installed into a sprinkler spray head to custom-select the spray characteristics for the water stream. Thereafter, periodic changing of the nozzle insert can be accomplished to tailor the specific water spray characteristics according to the maturation and growth of the surrounding vegetation or, alternately, according to changes in the vegetation type.

However, experience has revealed that a shortcoming of current carriers is that the inserts tend to become unintentionally detached. For example, in the course of packaging the nozzle sets or carrying nozzle sets in the field, individual nozzle inserts frequently are susceptible to accidental detachment from their associated carrier and can be lost. Thus, it is desired to have an improved nozzle insert set and corresponding carrier, including one that addresses the shortcoming associated with unintentional detachment of the inserts.

DETAILED DESCRIPTION OF THE PREFERRED EMBODIMENT(S)

Figure 1:
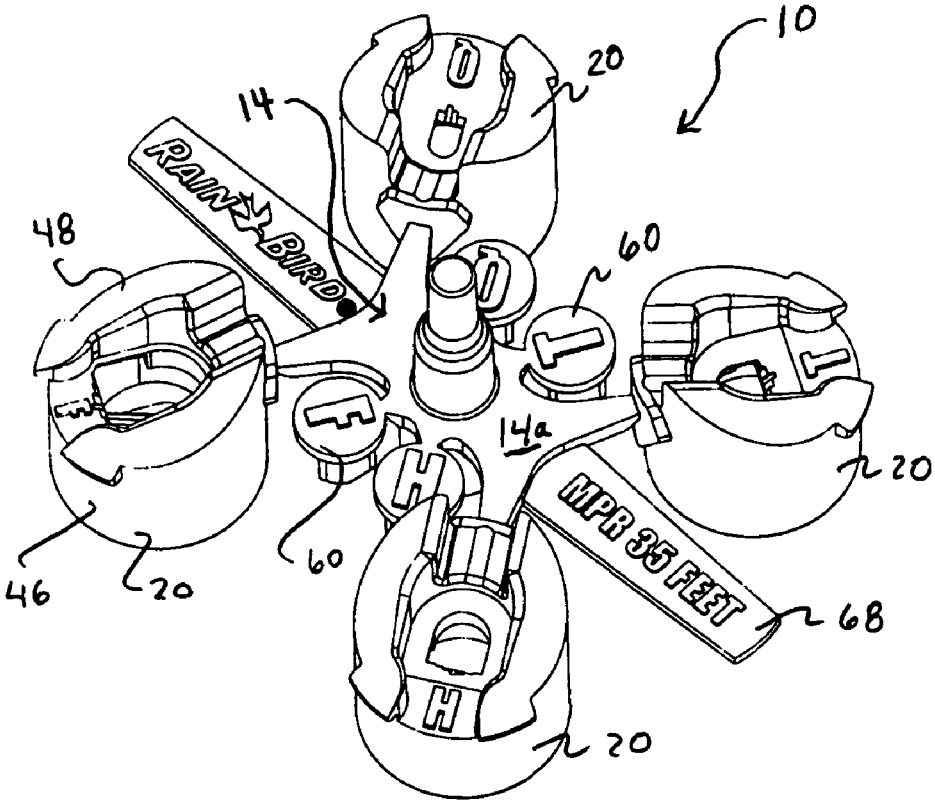
FIG. 1 is a perspective view of a nozzle set embodying features of the present invention.
Figure 5:
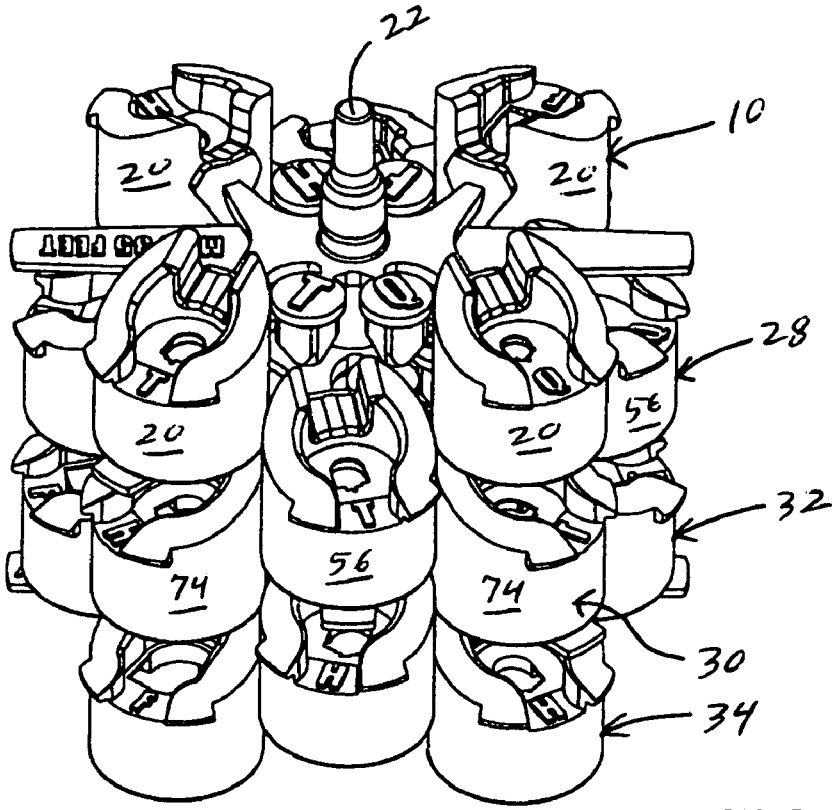
FIG. 5 is a perspective view of a plurality of nozzle sets of the kind of FIG. 1 associated together with one another.
Figure 6:
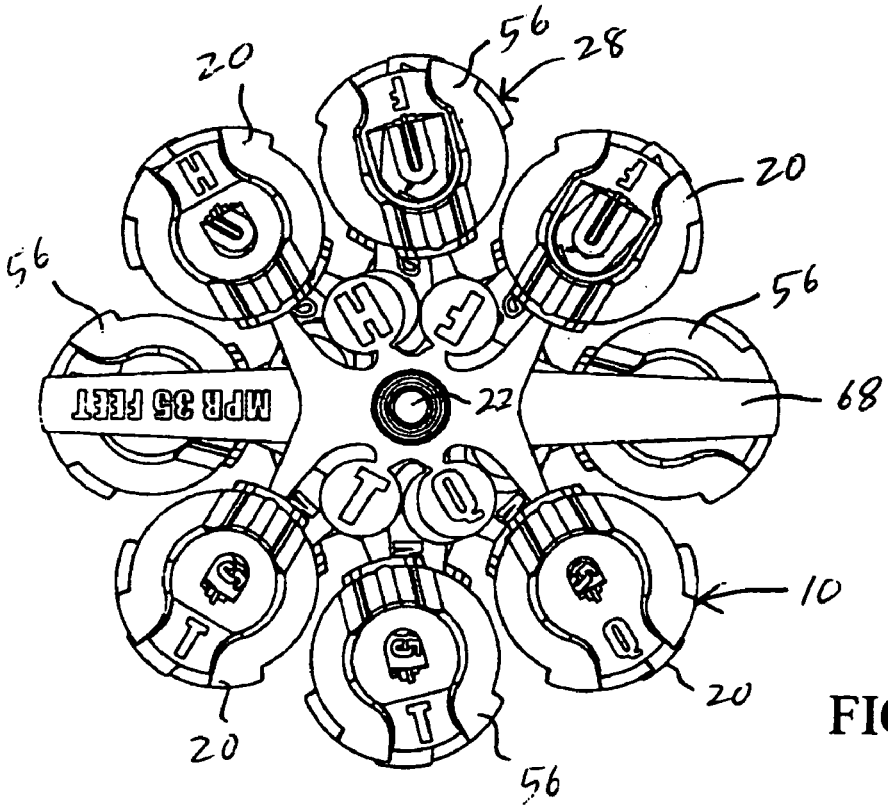
FIG. 6 is a top plan view of the associated plurality of nozzle sets of FIG. 5.
Figure 7:
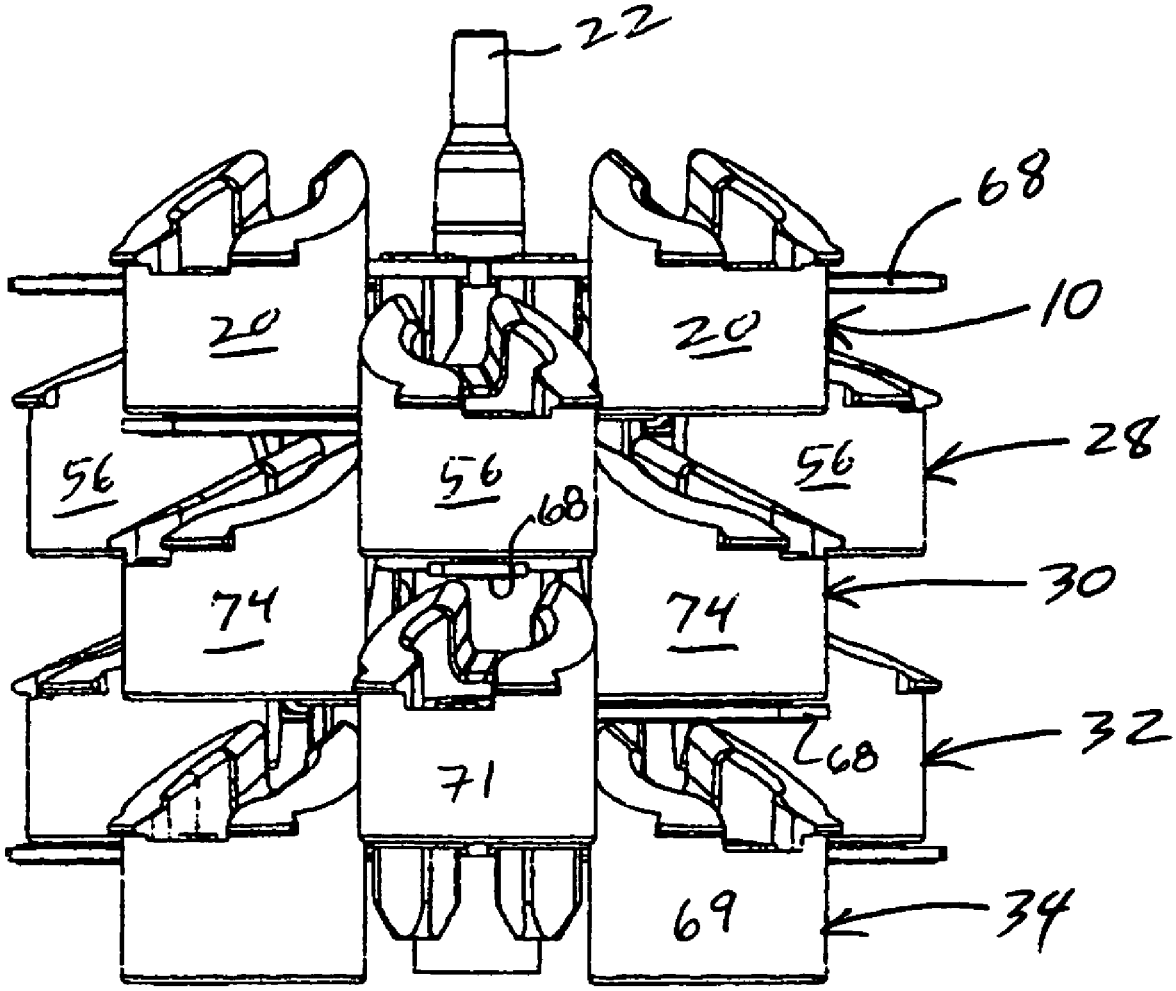
FIG. 7 is an elevational view of the associated plurality of nozzle sets of FIG. 5.
Figure 8:
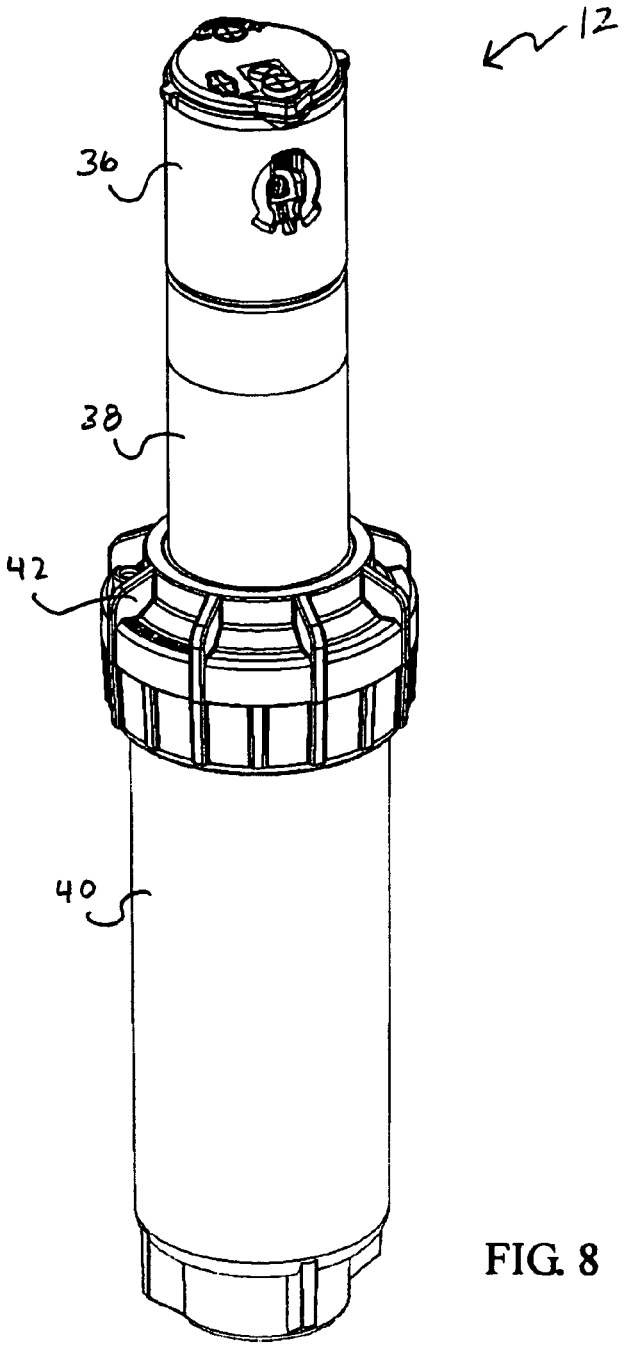
FIG. 8 is a perspective view of a pop-up sprinkler having a spray head in an elevated spraying position.

Referring to FIG. 1, a nozzle set 10 is shown for use with a pop-up sprinkler 12, such as that shown in FIG. 8. The nozzle set 10 includes a plurality of nozzle inserts 20 that are frangibly connected to a common carrier 14. The frangible connection permits removal for mounting into a spray head 36 of the sprinkler 12. The nozzle set 10 also is adapted for storage and transportation in a nested arrangement with other nozzle sets 28-34 of the same design, as illustrated in FIGS. 5-7. The combination of the structure of each individual nozzle set 10 and their manner of nesting with each other provides for effective and efficient packaging, storage, handling, and transportation of a relatively large number of nozzle insert sets in an arrangement that protects the inserts from accidental detachment from their respective carrier.

Figure 9:
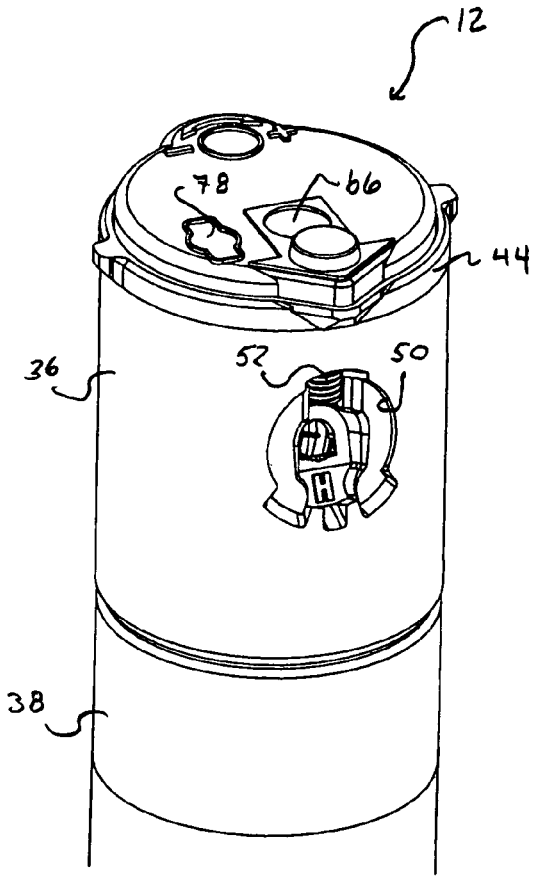
FIG. 9 is an enlarged fragmented perspective view of the sprinkler spray head of FIG. 8.

The nozzle inserts 20 of the set 10 are used with the pop-up sprinkler 12 of the type having a rotary drive mechanism (not shown) that controls the rotation of the elevated spray head 36 so as to rotate through a continuous full circle revolution or, alternately, back and forth within a predetermined partial arcuate path to sweep the projected water stream over a selected target terrain area. As shown in FIGS. 8-9, the spray head 36 is mounted at the upper end of a pop-up riser 38 which is telescopically received in a sprinkler housing or case 40. The spray head 36 and the riser 38 move between a normal position retracted into and substantially concealed within the case 40 and an elevated spraying position.

More specifically, the riser 38 and the spray head 36 are slidably movable through a central opening defined by an annular cap 42 mounted on an upper end of the housing 40. A retraction spring (not shown) normally urges the riser 38 and spray head 36 downwardly to the normally-retracted position, with the bottom surface of the riser 38 seated firmly against the bottom inside of the housing 40. When pressurized water is supplied to the sprinkler housing 40, typically through an inflow port (not shown) at the housing bottom, the riser 38 is shifted telescopically upward by the water under pressure to the elevated spraying position with the spray head 36 positioned above the upper extent of the housing 40 and associated cap 42, as shown in FIG. 8.

In the elevated spraying position, the spray head 36 projects a water stream or spray radially outwardly to irrigate surrounding terrain and vegetation. The rotary drive mechanism for the pop-up sprinkler 12 is normally mounted within the sprinkler housing 40 or within the interior of the riser 38 and functions to rotate the spray head 36 in a manner that sweeps the projected water stream (not shown) through continuous full circle revolutions or, alternately, back and forth within the boundaries of a predetermined arcuate path. The specific spray characteristics of the projected water stream, such as flow rate, trajectory, stream width, etc., are controlled by the geometry of the nozzle insert 20 (FIG. 1) mounted in the spray head 36 and defining a nozzle flow path from which the water stream is projected from the spray head 36.

With reference to FIG. 1, for example, each nozzle insert 20 includes a generally cylindrical body 46 and a face surface 48 which combine for convenient reception into a cooperating nozzle cavity 50 defined by the spray head 36 (FIG. 9). A set screw 52 (FIG. 9) on the spray head 36 is provided and may also extend partially into the projected water stream (not shown) for additionally tailoring the stream configuration, wherein the set screw 52 may also engage an opening 54 (FIG. 2) of the nozzle face surface 48 to assist in retaining the nozzle insert 20 within the sprinkler nozzle cavity 50.

Referring to FIGS. 1-4, the common carrier 14 of the nozzle set 10 includes a generally planar center member having a first side 16 and a second side 18. The plurality of nozzle inserts 20 are frangibly connected to the center member 14 and are arranged in a generally radial-shaped pattern or array. An upper post 22 extends orthogonally from a central location of the first side 16 of the center member 14. The preferred posts 22 include two generally cylindrically-shaped sections 22*a* and 22*b* having different cross-section sizes and aligned along the same longitudinal axis. The proximal section 22*a* is approximately equal in length to the distal section 22*b*. A third section 22*c* is an intermediate section that transitions between the first and second sections 22*a* and 22*b*.

A lower post 24 extends orthogonally from a central location of the second side 18 of the center member 14 in a direction generally aligned along the same longitudinal axis as the upper post 22. As previously mentioned, the nozzle set 10 is adapted for storage and transportation in a nested arrangement with one or more other nozzles sets 28,30,32,34 of similar construction. (FIG. 5). Thus, the lower post 24 of the nozzle set 10 defines a longitudinal bore 26 that extends through the center member 14 and into the upper post 22 and is adapted to receive an upper post, such as the upper post 22, of any one of the other nozzle sets 28, 30, 32, 34. Similarly, any post 22 of any one of the other nozzle sets 28, 30, 32, 34 is adapted to mate with the bore 26 of the first nozzle set 20 and with any bore 26 of any of the other nozzle sets. The stepped cross-section design of the upper post 22 facilitates easy insertion and seating into a bore of a lower post 24. More specifically, the reduced cross-section of the distal section 22*b* facilitates easy insertion into the bore of a lower post 24. The cross-section dimension of the proximal section 22*a* is such that the outer surface is adjacent to the surface of a lower post 24 defining the internal bore, which prevents lateral shifting of the nozzle sets relative to one another. Indeed, in the preferred embodiment, the surfaces can slide against one another to create a slight friction fit between the two. Thus, when the upper post of one nozzle set is mated with the bore of the lower post of another nozzle set, the sets are connected so that radial separation of the sets relative to one another is inhibited while axial separation is permitted.

Figure 10:
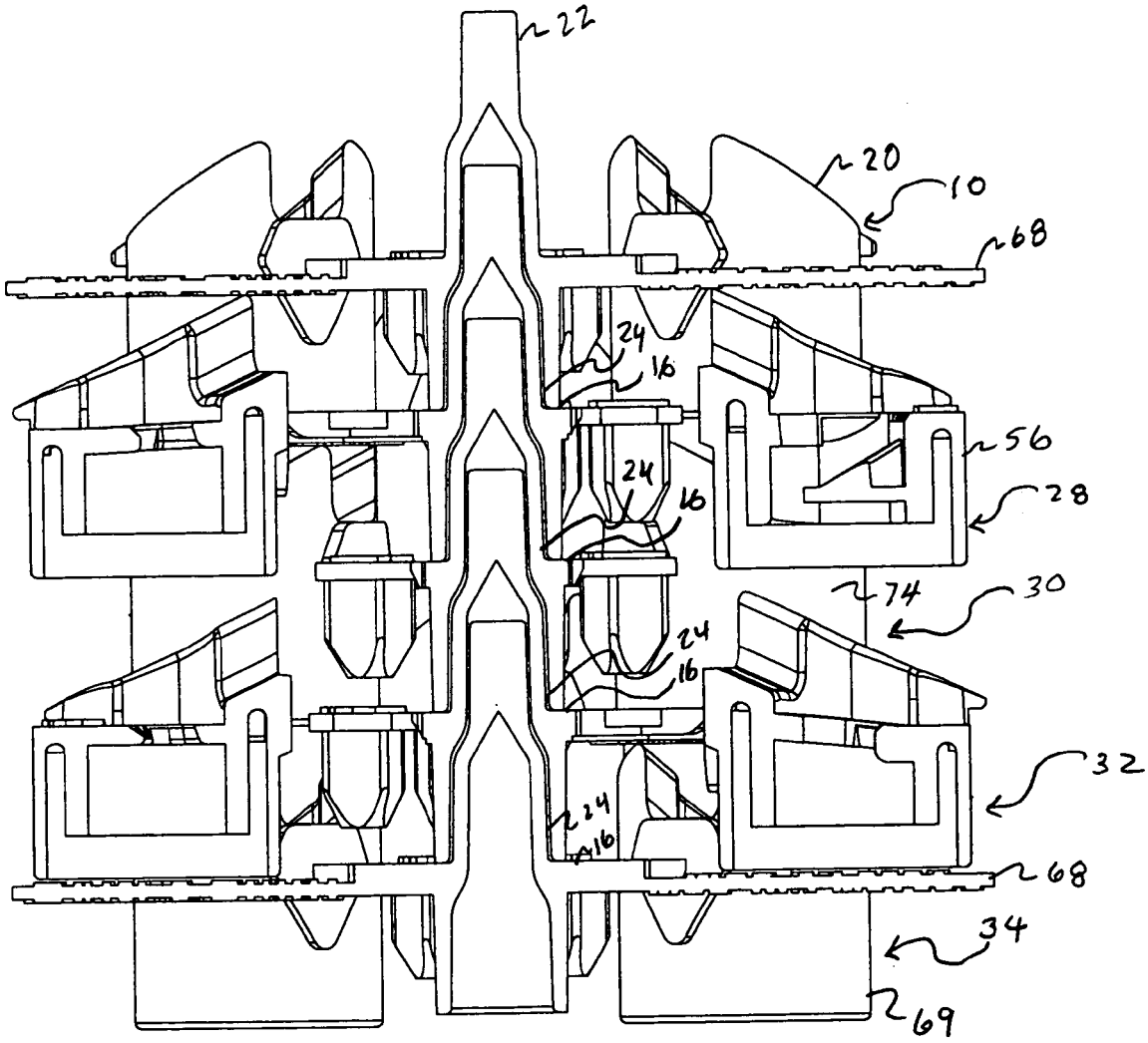
FIG. 10 is a cross-section view of a plurality of nozzle sets of the kind of FIG. 1 associated together with one another.

In addition, the bottom surface of the lower post 24 of one nozzle set seats on the top of the first side 16 of another nozzle set when the sets are coupled together as illustrated in FIG. 10. In a stacked arrangement, this seating protects the nozzles from a compressive load along the axis defined by the posts. A stack of nozzles dropped vertically will be largely protected because the central column made up of the posts will absorb the impact.

While the illustrated embodiment employs a coupler including a post for one nozzle insert set and a corresponding bore for another nozzle insert set, it is contemplated that other couplers and arrangements and geometries may be employed. For instance, other suitable couplers may include latches, hooks, clamps, fasteners, keepers, pins, links, screws, nuts and bolts, etc.

As seen in FIGS. 5-7, the plurality of nozzle inserts 20 of the nozzle set 10 are disposed so that each insert 20 is interposed between two nozzle inserts 56 of another adjacently stacked nozzle set 28 and vice versa. The nozzle inserts 20 and 56 of the adjacent sets are staggered longitudinally so that, preferably, the nozzles overlap by at least a portion of their height. The adjacent nozzles also are spaced circumferentially from one another with a relatively tight arrangement so as to minimize rotational movement about the longitudinal axis of the post structure of the insert sets relative to one another. Indeed, adjacent nozzle inserts may be interposed with one another so that they abut or are in dose proximity to one another. In this nested arrangement, the nozzle inserts to either side and those above and below a specific nozzle, protect the nozzle inserts from accidental detachment and loss. The stacked and nested arrangement permits an installer to conveniently carry in one hand a large number of nozzles.

Figure 2:
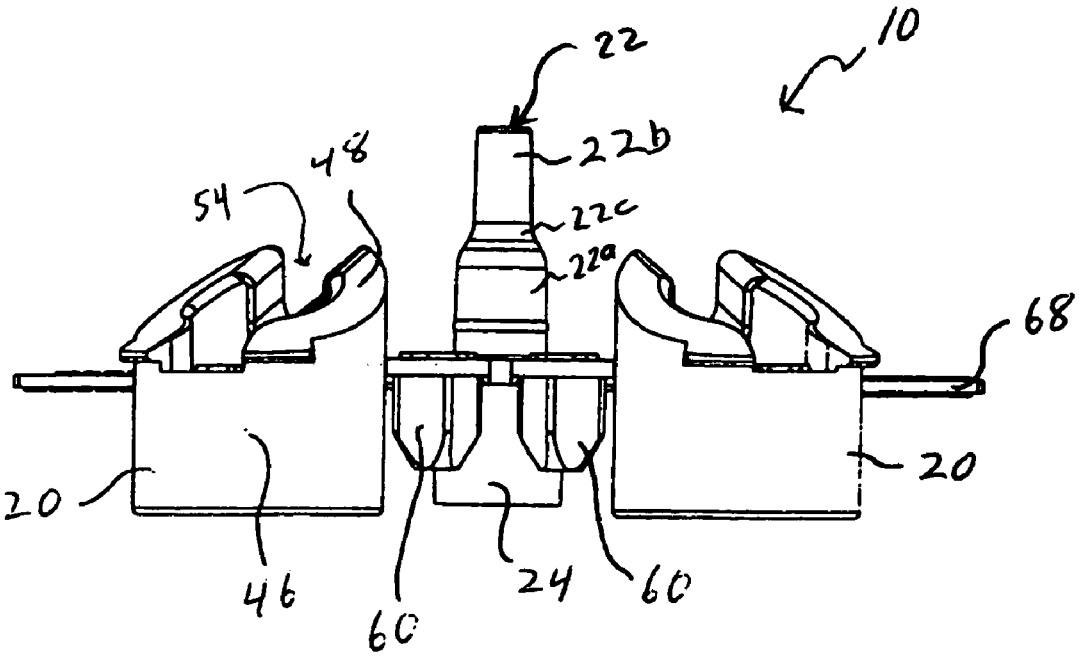
FIG. 2 is an elevational plan view of the nozzle set of FIG. 1.
Figure 3:
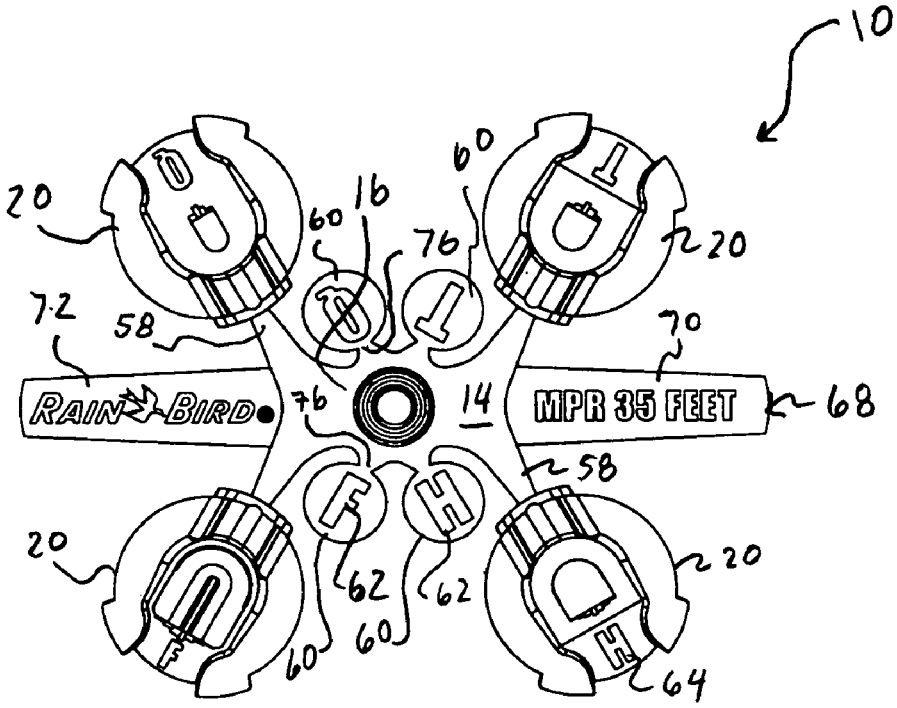
FIG. 3 a top plan view of the nozzle set of FIG. 1.
Figure 4:
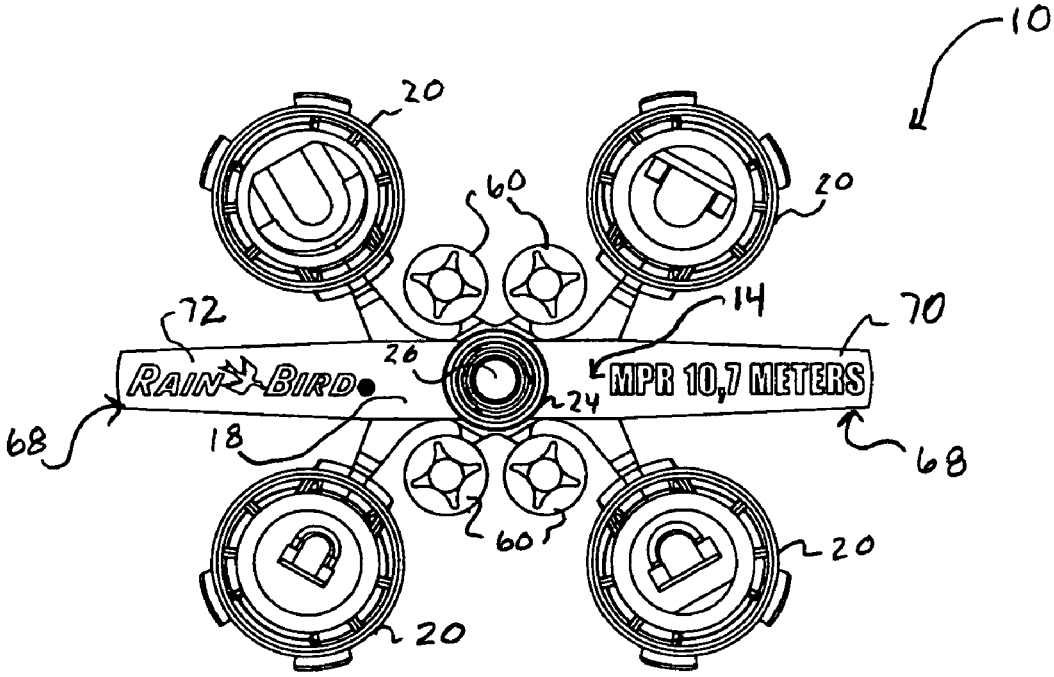
FIG. 4 is a bottom plan view of the nozzle set of FIG. 1.

Each of the nozzle inserts 20 for the nozzle set 10 has substantially the same exterior geometric configuration suitable for seated mounting onto the spray head 36 of the sprinkler 12. However, as shown in FIGS. 1-3, the individual nozzle inserts 20 carried by the carrier 14 can be designed to provide for flow paths of different geometries to produce projected water streams with different predetermined spray characteristics. The plurality of sets 10, 28, 30, 32 and 34 of nozzle inserts may be provided for a selection of different water stream spray trajectories, widths, flow rates, etc. This arrangement permits a selection of one specific nozzle insert, according to the current irrigation requirements associated with a particular sprinkler in an irrigation system, for quick and easy installation of the selected nozzle insert onto the spray head of the particular sprinkler. In this regard, one set or a plurality of nozzle sets may be provided with each sprinkler as part of the original supplied unit, whereupon the sprinkler may be provided initially without regard to the desired spray patterns. The sprinklers may then be individually custom-tailored by the installers to optimize the water stream spray pattern according to the current irrigation needs associated with each individual sprinkler. Thereafter, the unused nozzle inserts can be retained to permit quick and easy changing of the nozzle insert when and if a different water stream spray pattern is required at a future date.

Each nozzle set 10, 28, 30, 32, 34 may be economically formed as a unitary or one-piece plastic component by injection molding. In this regard, the center member 14*a* of the carrier 14 is formed to have a generally planar-shaped central body with the nozzle inserts 20 frangibly connected to the periphery thereof by radially tapering arms 58. The tapering configuration of the arms 58 allow for easy detachment of each of the inserts 20. More specifically, insert detachment is accomplished by severing the arm 58, preferably at its narrowest cross-section adjacent the insert, through manual twisting or pulling or by cutting with a tool, such as a scissors, of the desired insert 20. While the illustrative embodiment shows a total of four nozzle inserts 20 connected to the carrier 14, it is contemplated that the number of inserts may be increased or decreased.

Also frangibly connected to the carrier 14 via shortened arms 76 is a plurality of identification plugs 60. Each plug 60 has an identification letter 62 that corresponds to a similar identification letter 64 appearing on the corresponding insert 20. In the illustrated embodiment, the identification letter "F" on a nozzle insert 20 indicates that this particular insert is designed to for use with a sprinkler that is adjusted to provide a full circle spray pattern. Thus, when this insert is placed in use, the corresponding identification plug 60 bearing the same letter 62 can be removed from the center member 14 and inserted into a receiving recess 66 located on the top of the sprinkler spray head 36. The identification plugs 60 enable easy determination of the type of nozzle insert that is currently installed in the sprinkler 12. In the illustrated embodiment, other identification letters 62, 64 include the letters "H", "T" and "Q" for nozzles designed for use with sprinklers that are set to provide half-circle, third-circle and quarter-circle spray patterns, respectively.

Extending radially outwardly in opposite directions from the center member 14*a* of the carrier 14 is a protective strip 68. The strips 68 each protrude slightly past the cylindrical body 46 of the nozzle inserts 20. The preferred indexing of one nozzle set with the next provides additional protection for each nested stack of inserts.

More specifically, the preferred indexing is where the strips 68 of the next stacked nozzle set extend over immediately adjacent nozzle inserts. For example, as illustrated in FIG. 7, the protective strip 68 of insert set 32 overlies insert 69 of insert set 34, and the protective strip 68 of the next insert set 30 is indexed one insert over to overlie insert 71 of insert set 32. This continues up the stack for the preferred indexing arrangement. If a preferred indexed arrangement of nested nozzle sets is dropped on the ground sideways, the protective strips 68 effectively absorb the impact. This reduces the likelihood that the inserts will detach due to the impact. Also, a properly indexed arrangement of nested nozzle sets can be rolled on a flat surface without the nozzle inserts touching the surface. That is, the length of the protective strips 68 is sufficiently long enough to space the nozzle inserts from the surface.

In addition, one portion 70 of the strip 68 is used to designate the design water throw radius (e.g., 35 feet or 10.7 meters) of all of the nozzles 20 belonging to that nozzle set 10 and to designate that all nozzles 20 are designed to provide a uniform matched precipitation rate (e.g. "MPR"). A matched precipitation rate refers to the capabilities of all nozzles of the set to provide approximately the same amount of water per unit time over the covered area regardless of whether a full, half, third or quarter circle spray nozzle is used. In the illustrated embodiment, another portion 72 of the strip 68 can be used for displaying any other desired information, such as for example, the name or logo of the manufacturer.

Referring again to FIG. 5, some of the nozzle sets 10, 28, 30, 32, 34 vary from one another by including a plurality of nozzle inserts designed for differing water spray radii and are color coded accordingly. In one embodiment, for example, the top nozzle set 10 includes nozzles 20 that are each designed for a 35 foot (10.7 meter) spray radius at a predetermined water pressure and is color coded with the color brown. The next nozzle set 28 includes a plurality of nozzles 56 that are each designed for a 30 foot (9.1 meter) spray radius at the same predetermined water pressure and is color coded with the color green. The third nozzle set 30 includes a plurality of nozzle inserts 74 that are each designed for a 25 foot (7.6 meter) spray radius at the same predetermined water pressure and is color coded with the color red. However, other color coding schemes and design water throw radii may be used. By employing this color-coding scheme, the user can quickly select the nozzle set designed for the desired water throw radius from the plurality of nested nozzles sets 10, 28, 30, 32 and 34 that the user may be carrying.

When it is desired to access the sprinkler spray head 36 for installing one of the nozzle inserts 20 thereon, either during initial sprinkler installation or for subsequently changing the nozzle insert to achieve a different spray pattern, a lift tool (not shown) is inserted into a slot 78 on the top of the spray head 36, turned 90° and, then, pulled in order to engage and elevate the spray head 36. More particularly, one end of the lift tool is inserted downwardly into the keyhole-shaped slot 78 (FIG. 9) formed in the top of the spray head 36. The slot 78 leads to an undercut recess (not shown). By rotating the tool approximately 90° relative to the spray head 36, stem tabs or ears on the end of the tool (not shown) are rotated within the undercut recess to a position for engaging the underside of the top wall of the spray head 36. In this position, the lift tool can be manually lifted to raise the spray head 36 from the normal retracted position toward the elevated spraying position.

While the spray head 36 is in the elevated position, as viewed in FIGS. 8-9, the chosen nozzle insert 20 can be installed quickly and easily into the cavity 50 of the spray head 36. Such installation may be incident to original set-up of the irrigation system, or it may occur at a later time when irrigation requirements warrant replacement of an existing nozzle insert with a new or different one to change the water stream spray pattern. The selected nozzle insert 20 is readily separated from the carrier 14 by snap-off detachment wherein the associated arm 58 is severed by appropriate bending or twisting or cutting. When the desired nozzle insert 20 is fully installed, the lift tool can be manipulated to return the spray head 36 to the normal retracted position and, then, reoriented for separation of the tool stem from the spray head 36. The unused nozzle inserts 20 may remain attached to the carrier 14 of the nozzle set 10 during the entire nozzle insert installation process.

While the description above refers to particular embodiments having features of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive. The scope of the invention being indicated by the claims rather than the foregoing description, and all changes which come within the meaning and range of equivalency of the claims are therefore intended to be embraced therein.

What is claimed is:

1. An arrangement of at least two sets of nozzle inserts for use in irrigation systems comprising:

a first carrier;

a first set of irrigation nozzle inserts releasably connected to the first carrier, each insert having a body portion adapted for reception in a cooperating nozzle cavity and each insert defining a port configured for distribution of water in a predetermined irrigation spray pattern;

a second carrier;

a second set of irrigation nozzle inserts releasably connected to the second carrier, each insert having a body portion adapted for reception in a cooperating nozzle cavity and each insert defining a port configured for distribution of water in a predetermined irrigation spray pattern;

a coupler capable of releasably interconnecting the second carrier with the first carrier;

wherein the irrigation nozzle inserts of the first and second sets being at least partially nested among each other when the first carrier is interconnected with the second carrier to resist unintentional detachment of the nozzle inserts from their respective carrier;

wherein the irrigation nozzle inserts of the respective sets are disposed so that each is interposed between two irrigation nozzles inserts of the other set when the first carrier is interconnected with the second carrier;

wherein the irrigation nozzle inserts of the first and second sets are disposed in a generally radial-shaped pattern about their respective carrier;

wherein the first and second carriers each include a plurality of arms and each irrigation nozzle insert is connected to its respective carrier by at least one of the arms;

wherein the coupler comprises one of the first and second carriers having a projection and the other of the first and second carriers defining a recess that receives the projection to releasably interconnect the second carrier with the first carrier.

2. An arrangement of at least two sets of nozzle inserts in accordance with claim 1 wherein the recess of one of the first and second carriers includes a distal end that engages the other of the first and second carriers to resist detachment of at least one of the nozzle inserts by external forces on the arrangement.

3. An arrangement of at least two sets of nozzle inserts in accordance with claim 2 wherein the projection extends generally perpendicular to the at least one of the arms of the first carrier or the second carrier.

4. An arrangement of at least two sets of nozzle inserts in accordance with claim 1 wherein each nozzle insert further comprises a face surface having an opening for reception of a member for retaining the nozzle insert in the nozzle cavity.

5. An arrangement of at least two sets of nozzle inserts for use in irrigation systems comprising:

a first carrier;

a first set of irrigation nozzle inserts releasably connected to the first carrier, each insert having a body portion adapted for reception in a cooperating nozzle cavity and each insert defining a port configured for distribution of water in a predetermined irrigation spray pattern;

a second carrier;

a second set of irrigation nozzle inserts releasably connected to the second carrier, each insert having a body portion adapted for reception in a cooperating nozzle cavity and each insert defining a port configured for distribution of water in a predetermined irrigation spray pattern;

a coupler capable of releasably interconnecting the second carrier with the first carrier;

at least one identification tag removably connected to at least the first carrier or second carrier;

wherein the irrigation nozzle inserts of the first and second sets being at least partially nested among each other when the first carrier is interconnected with the second carrier to resist unintentional detachment of the irrigation nozzle inserts from their respective carrier;

wherein the at least one identification tag is frangibly connected to at least the first carrier or second carrier;

wherein the at least one identification tag is a plug.

6. An arrangement of at least two sets of nozzle inserts for use in irrigation systems comprising:

a first carrier;

a first set of irrigation nozzle inserts releasably connected to the first carrier, each insert having a body portion adapted for reception in a cooperating nozzle cavity and each insert defining a port configured for distribution of water in a predetermined irrigation spray pattern;

a second carrier;

a second set of irrigation nozzle inserts releasably connected to the second carrier, each insert having a body portion adapted for reception in a cooperating nozzle cavity and each insert defining a port configured for distribution of water in a predetermined irrigation spray pattern;

a coupler capable of releasably interconnecting the second carrier with the first carrier;

at least one arm extending from each of the first and second carriers to resist detachment of at least one of the irrigation nozzle inserts by external forces on the arrangement;

wherein the irrigation nozzle inserts of the first and second sets being at least partially nested among each other when the first carrier is interconnected with the second carrier to resist unintentional detachment of the irrigation nozzle inserts from their respective carrier;

wherein the at least one arm extending from each of the first and second carriers include an information display surface.

7. A set of nozzle inserts for use in irrigation systems comprising:

a plurality of irrigation nozzle inserts, each insert having a body portion adapted for reception in a cooperating nozzle cavity and each insert defining a port configured for distribution of water in a predetermined irrigation spray pattern; and a carrier to facilitate transport of the plurality of irrigation nozzle inserts, the carrier having a plurality of arms extending generally radially therefrom and each arm attaching to one of the plurality of irrigation nozzle inserts to form an array of irrigation nozzle inserts;

wherein the carrier further comprises a central hub with each of the arms extending generally radially therefrom to a frangible connection with each of the irrigation nozzle inserts to be able to detach the irrigation nozzle inserts;

wherein the carrier further comprises a first post extending from the central hub; and wherein the first post includes a distal end portion and a proximal portion relative to the central hub and wherein the distal end portion and the proximal portion have different cross-section sizes.

8. A set of nozzle inserts for use in irrigation systemscomprising:

a plurality of irrigation nozzle inserts, each insert having a body portion adapted for reception in a cooperating nozzle cavity and each insert defining a port configured for distribution of water in a predetermined irrigation spray pattern; and a carrier to facilitate transport of the plurality of irrigation nozzle inserts, the carrier having a plurality of arms extending generally radially therefrom and each arm attaching to one of the plurality of irrigation nozzle inserts to form an array of irrigation nozzle inserts;

wherein the carrier further comprises a central hub with each of the arms extending generally radially therefrom to a frangible connection with each of the irrigation nozzle inserts to be able to detach the irrigation nozzle inserts; and wherein the carrier further comprises a first post extending from the central hub and a second post defining an internal bore.

9. A set of nozzle inserts for use in irrigation systems comprising:

a plurality of irrigation nozzle inserts, each insert having a body portion adapted for reception in a cooperating nozzle cavity and each insert defining a port configured for distribution of water in a predetermined irrigation spray pattern;

a carrier to facilitate transport of the plurality of irrigation nozzle inserts, the carrier having a plurality of arms extending generally radially therefrom and each arm attaching to one of the plurality of irrigation nozzle inserts to form an array of irrigation nozzle inserts; and a plurality of identification tags removably attached to the carrier;

wherein the carrier further comprises a central hub with each of the arms extending generally radially therefrom to a frangible connection with each of the irrigation nozzle inserts to be able to detach the irrigation nozzle inserts; and wherein the carrier further comprises a first post extending from the central hub.

10. A set of nozzle inserts in accordance with claim 9 wherein each of the plurality of identification tags is a frangibly detachable plug.

11. A set of nozzle inserts in accordance with claim 9 wherein each of the plurality of identification tags corresponds to a different one of the plurality of nozzle inserts.

12. A set of nozzle inserts for use in irrigation systems comprising:

a plurality of irrigation nozzle inserts, each insert having a body portion adapted for reception in a cooperating nozzle cavity and each insert defining a port configured for distribution of water in a predetermined irrigation spray pattern;

a carrier to facilitate transport of the plurality of irrigation nozzle inserts, the carrier having a plurality of arms extending generally radially therefrom and each arm attaching to one of the plurality of irrigation nozzle inserts to form an array of irrigation nozzle inserts; and at least one extension protruding radially from the carrier beyond the plurality of irrigation nozzle inserts to resist detachment of at least one of the irrigation nozzle inserts by external forces on the set;

wherein the carrier further comprises a central hub with each of the arms extending generally radially therefrom to a frangible connection with each of the irrigation nozzle inserts to be able to detach the irrigation nozzle inserts; and wherein the carrier further comprises a first post extending from the central hub.

* * * * *

UNITED STATES PATENT AND TRADEMARK OFFICE

CERTIFICATE OF CORRECTION

PATENT NO. : 7,472,840 B2
APPLICATION NO. : 10/883940
DATED : January 6, 2009
INVENTOR(S) : Christian T. Gregory It is certified that error appears in the above-identified patent and that said Letters Patent is hereby corrected as shown below:

Column 8, Line 56-57, delete “systemscomprising” and insert -- systems comprising -- therefor.

Signed and Sealed this

Nineteenth Day of May, 2009

John Doll

JOHN DOLL
*Acting Director of the United States Patent and Trademark Office*